United States Patent [19]

Prunty

[11] Patent Number: 4,750,653

[45] Date of Patent: Jun. 14, 1988

[54] HIP-SLING BABY CARRIER WITH LEG WARMERS

[75] Inventor: Kay J. Prunty, Buckley, Wash.

[73] Assignee: Toddler Crafts Corp., Buckley, Wash.

[21] Appl. No.: 940,157

[22] Filed: Dec. 9, 1986

Related U.S. Application Data

[63] Continuation of Ser. No. 799,349, Nov. 18, 1985, abandoned.

[51] Int. Cl.[4] ..... A61G 1/00

[52] U.S. Cl. ..... 224/159; 224/158

[58] Field of Search ..... 224/159, 158, 160; 36/2 R

[56] References Cited

U.S. PATENT DOCUMENTS

| | | | |
|---|---|---|---|
| 2,376,657 | 5/1945 | Chamberlain | 224/159 |
| 2,429,507 | 10/1947 | Ballenger | 36/2 R |
| 3,575,326 | 4/1971 | Chappell | 224/159 |
| 4,165,558 | 9/1979 | Schroeder | 244/158 |
| 4,389,005 | 6/1983 | Cable et al. | 244/159 |
| 4,492,326 | 1/1985 | Storm | 244/160 |
| 4,544,088 | 10/1985 | Reding | 224/159 |

FOREIGN PATENT DOCUMENTS

| | | | |
|---|---|---|---|
| 71110 | 3/1950 | Denmark | 224/159 |
| 2371906 | 6/1978 | France . | |
| 1560260 | 1/1980 | United Kingdom . | |

OTHER PUBLICATIONS

Strolee 1985 catalog, p. 21.
Gerry 1985 Baby Products catalog, p. 7.
House Beautiful, "Tools for Living", 1984.
Cousteau & Richards, Jacques Cousteau's Amazon Journey (no date).
Kay J. Prunty photograph, circa 1978.

*Primary Examiner*—Henry J. Recla
*Assistant Examiner*—David Voorhees
*Attorney, Agent, or Firm*—Graybeal, Jensen & Puntigam

[57] ABSTRACT

An improved hip sling baby or doll carrier comprising: a trough-shaped seat having a forward seat portion extending laterally between opposed seat ends and upwardly from a bottom fold of the seat to a front edge of the seat, a rearward seat portion extending laterally between said opposed seat ends and upwardly between the bottom fold and a top fold, and two leg holes extending through the seat, each hole being centered near the bottom fold; a carrier back extending from the top fold adjacent the rearward seat portion to a back edge, and terminating at either end at a back support point which is strongly anchored to an adjacent seat end near the bottom fold of the seat, said back support points tensioning the back edge to provide support for the baby's back; and a strap assembly having two straps, each attached at one end to a respective seat end, and a strap connecting means for connecting opposite free ends of the straps to each other, said strap connecting means comprising a length-adjustable, child-safe buckle. A substantially cylindrical fabric leg warmer is easily attached to and detached from the carrier adjacent a leg opening in said carrier, said leg warmer comprising grow tucks allowing the leg warmer to be lengthened to accommodate the growing legs of the child, and growth display means in the grow tucks providing an attractive and decorative indicator of the child's growth.

7 Claims, 4 Drawing Sheets

HIP-SLING BABY CARRIER WITH LEG WARMERS

CROSS-REFERENCE TO RELATED APPLICATION

This is a continuation of application Ser. No. 799,349, filed on Nov. 18, 1985, now abandoned.

BACKGROUND OF THE INVENTION

1. Technical Field

This invention relates to carriers for babies or dolls, and more particularly to an improved device for carrying a baby on the hip of an adult, or a doll on the hip of a child.

2. Description of the Prior Art

The field of baby carriers is a fertile one. Carriers are available which variously position the baby on the adult's front, back or hip. While front- and back-type carriers have achieved widespread acceptance, they suffer from several inherent disadvantages. Front-type baby carriers which face the baby toward the adult's chest prevent the baby from viewing its immediate surroundings. Front-type carriers which face the baby upwards similarly restrict the baby's field of view. Furthermore, front-type baby carriers can create severe, unnatural stresses in the adult's back and spine, especially when babies weighing more than ten or fifteen pounds are carried. Back-type carriers, which typically hold the baby level with the adult's shoulders, ameliorate these principal disadvantages of front-type carriers, reducing the stress in the adult's back and allowing the baby a wide field of view. However, back-type carriers effectively prevent the adult from observing the baby's behavior and directing its attention toward its surroundings. Thus an older baby, just beginning to take an active interest in its surroundings, is isolated from the adult who is its teacher and guide as well as its means of transportation.

Simple hip slings for carrying babies have been known for centuries. Generically, hip sling baby carriers consist of a looped sling having a seat which is placed beneath the baby's or doll's bottom, and a strap which is laid over the respective adult's or child's shoulder and diagonally downward across the torso like a bandolier. Simple hip sling carriers, constructed by knotting together two opposite ends of a single piece of fabric, are widely used in less-developed countries. One common improvement made to such carriers is the addition of crude leg holes in the seat portion, allowing the baby's legs to extend through the bottom of the seat, straddling the adult's hip. Unfortunately, these holes severely weaken the carrier, especially when relatively low quality fabric is used. Simple hip sling carriers also suffer from a radically unequal distribution of stresses in the fabric, caused by the simple folding method used to construct the carrier. Thus, simple hip sling baby carriers suffer from a serious danger of the fabric tearing while the carrier is in use, dropping the baby to the ground. A further disadvantage of simple hip slings is their lack of firm support for the baby's back. A simple hip sling carrier supports the baby's weight, but generally extends upwards only as far as the small of the baby's back, requiring the adult to support the baby's upper back by means of the adult's hand or arm.

Several improvements have been attempted on the basic hip sling design for a baby carrier. Many such "improved" carriers employ complicated arrangements of straps, buckles, pads, etc., increasing the difficulty of an adult donning or doffing the carrier without assistance, and necessarily adding to the carrier's cost. Examples of such complicated sling carriers are found in Schroeder U.S. Pat. Nos. 4,166,558, for Infant Carrier, Cable et al 4,389,005, for Infant Carrier, Storm 4,492,326, for Sling-type Infant Carrier, and Mothercare Ltd. U.K. Pat. No. 1,560,260, for Improvements In or Relating to Slings for Carrying Babies.

SUMMARY OF THE INVENTION

A principal feature of the present invention resides in an improved hip sling baby or doll carrier comprising a seat with forward and rearward portions, a back for supporting the baby's back, and a strap assembly for forming the carrier into a circular sling. The forward seat portion extends laterally between opposed seat ends and upwardly from a bottom fold of the seat to a front edge of the seat. The rearward seat portion extends laterally between said opposed seat ends and upwardly between the bottom fold and a top fold. Two leg holes extends through the seat, each hole being centered near the bottom fold. The forward and rearward seat portions form a trough-shaped seat in which the baby comfortably rides with its legs extending naturally through the leg holes. The back extends from the top fold adjacent the rearward seat portion to a back edge, which terminates at either end at a back support point which is strongly anchored to an adjacent seat end near the bottom fold of the seat. When the carrier is in use, the back support points tension the back edge which is supporting the baby's back. When the carrier is not in use, the carrier naturally assumes a closed position, in which the carrier forms a compact bundle. In this closed position the seat is folded flat with the forward seat portion adjacent the rearward seat portion, and the back is folded downward against the seat.

A further feature of the present invention resides in a substantially cylindrical fabric leg warmer for use with a baby or doll carrier. The leg warmer is easily attached to and detached from the carrier adjacent a leg opening in the carrier so that the leg warmer may be used only when desired, and allowing the leg warmer to be marketed as a separate accessory to the carrier.

Other features and advantages of the present invention will become apparent from the following detailed description of a typical embodiment thereof, taken in conjunction with the accompanying drawings.

DESCRIPTION OF THE PREFERRED EMBODIMENTS

Figure 1:
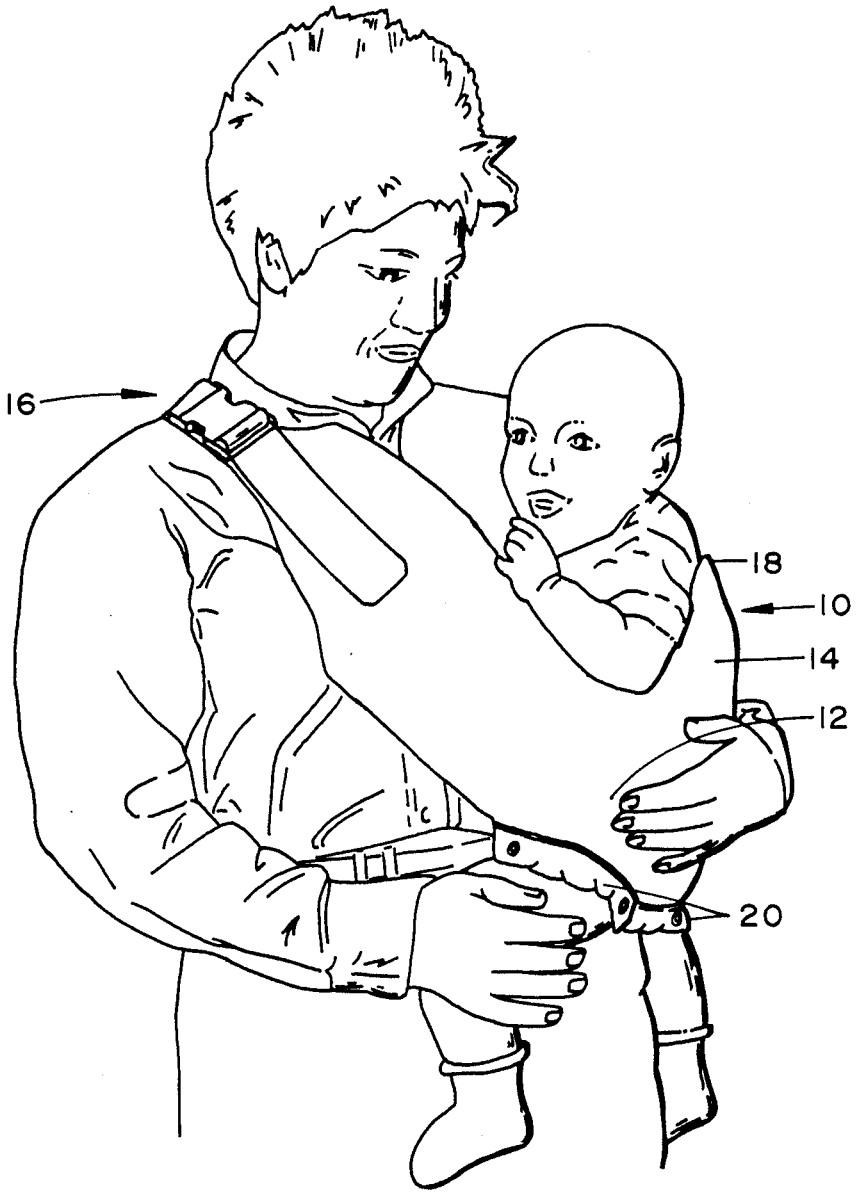
FIG. 1 is a perspective view of an adult using the presently preferred embodiment of the improved hip sling baby or doll carrier of this invention to carry a baby on the adult's hip.

As best seen in FIG. 1, the carrier 10 of the present invention is used by an adult to carry a baby on the adult's hip with the baby's weight distributed between the adult's hip and opposite shoulder, or by a child to carry a doll on the child's hip in the same manner as an adult would carry a baby with the carrier. The carrier 10 comprises a seat 12, a carrier back 14 and a strap assembly 16. In use, the strap assembly 16 is placed over one of the adult's shoulders, and diagonally downward across the chest and back of the adult, and the seat 12 is positioned adjacent the adult's hip. A back edge 18 of the carrier back 14 raised to support the baby's back. The baby is placed in the seat 12 facing the adult, with its legs extending through two leg holes 20 located in the bottom portion of the seat 12, and its back supported by the carrier back 14. With the baby supported in the carrier in this manner, the adult can comfortably carry the baby in carrier 10 for extended periods without fatigue.

Figure 2:
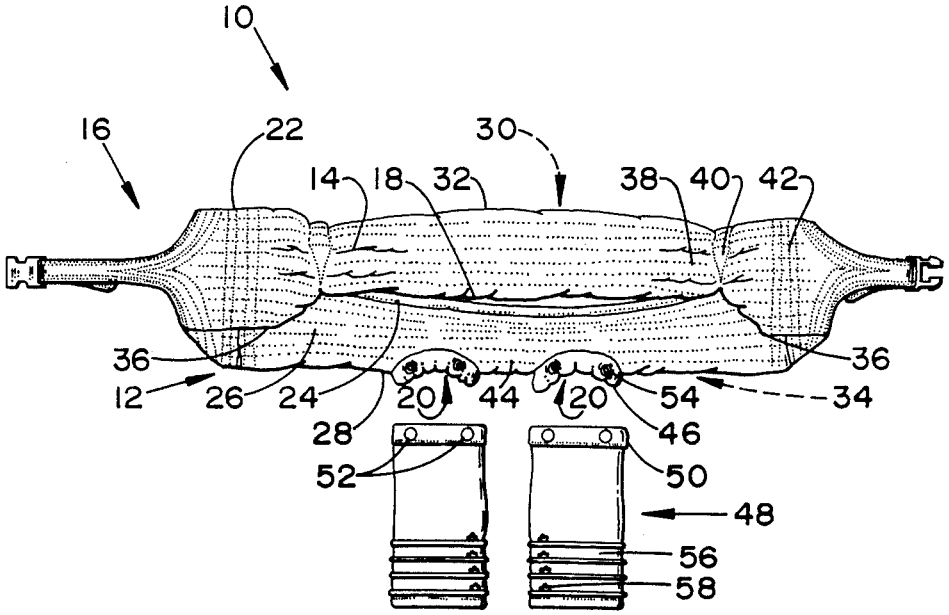
FIG. 2 is a plan view of the carrier of FIG. 1 in a closed position, showing the strap assembly, the back in a folded position, and the detachable leg warmers.

As seen in FIG. 2, the trough-shaped seat 12 extends laterally between two seat ends 22. When the carrier 10 is in use, a front edge 24 of the seat 12, edged with soft, thick fabric to provide additional support for the baby's lower front torso, is positioned adjacent the adult's midsection. From the front seat edge 24, a forward portion 26 of the seat 12 extends downwardly to a bottom fold 28 which is pierced by the leg holes 20. From the bottom fold 28, a rearward portion 30 (behind in FIG. 2, and shown in part in FIG. 3) of the seat 12 extends rearwardly and upwardly to a top fold 32 adjacent the back 14. The seat 12 is preferably constructed from two layers of conventional quilting consisting of a layer of thick but lightweight batting sandwiched between two facing layers of light-weight fabric, producing a cushiony, washable, pliable yet strong seat 12. A heavyweight fabric seat liner 34 further reinforces the seat 12. The seat liner 34 is itself sandwiched between the two layers of quilting in the seat 12, effectively removing the liner from view and preventing contact between the liner and the baby's skin.

The carrier back 14 extends from the top fold 32 to the back edge 18. The back edge 18 extends laterally between two back support points 36. Each back support point 36 is located at one of the seat ends 22 at a point nearer to the bottom fold 28 of the seat 12 than to the top fold 32. This location of the back support points 36 causes the carrier back 14 to be folded down-ward toward the seat 12 when the carrier is not in use. When a baby is being carried in the carrier 10, the back support points 36 tension the back edge 18 downwardly, which tension tightens the back edge against the baby's back, providing firm constant support of the baby's back. It has been determined that the back support points 36 are optimally located such that the distance between the top fold 32 and the back support point is two to three times the distance between the back support point and the bottom fold 28.

Two gathers 38 in the fabric of the back 14 located near the seat ends 22 draw the back edge 18 toward the top fold 32. The gathers 38 increase the tension in the back edge 18 when the baby is being carried, providing effective support of the baby's back without the rigid or semi-rigid stiffeners required by other carrier designs, particularly the front-type carriers. Each gather 38 comprises several laterally oriented, Z-shaped double folds in the fabric forming the carrier back 14, held in place by tripled back gather stitching 40. The gather stitching 40 forms a triangle or a chevron having an internal angle of about twenty degrees (20°), with its apex located near the back edge 18 and each side extending downwardly from the apex toward the seat 12 for one and three-quarters inches ($1\frac{3}{4}''$). The back gather stitching 40 effectively distributes the stresses created by the gathers 38 into and throughout the fabric of the back 14.

In FIG. 2, the improved carrier 10 of this invention is shown folded into a closed position wherein the seat 12 is folded flat, with the forward seat portion 26 positioned flush adjacent the rearward seat portion 30, and the carrier back 14 is folded flat, with the back edge 18 adjacent the forward seat portion. In the closed position, the carrier 10 forms a substantially rectangular package which can be easily folded again and stored in a minimum of space. When the carrier 10 is not in use, the carrier back 14 naturally folds flat due to the location of the back support points 36 near the bottom fold 28. Similarly, the seat 12 naturally folds flat due to the front edge 24 of the seat being located near the top fold 32.

The carrier back 14 and seat 12 are firmly attached to each seat end 22 by several rows of parallel seat end reinforcing stitching 42 extending between the upper edge of the seat end 22 adjacent the top fold 32 and the lower edge of the seat end adjacent the bottom fold 28. The back support points 36 anchoring the back edge 18 are thus located under the inwardmost row of seat end reinforcing stitching 42 closest to the center of the carrier 10. The ends of the front seat edge 24 are anchored similarly to the ends of the back edge 18, but in reversed relation thereto, with the distance from said anchor point to the bottom fold 28 being between two and three times the distance from said anchor point to the top fold 32. This anchoring tensions the front seat edge 24 when the carrier 10 is in use, providing a firmly supported seat for the baby. The seat end reinforcing stitching 42 also serves to minimize the stretching between the upper and lower edges of the seat end 22.

The two leg holes 20 which allow the baby's legs to extend through the seat 12 and straddle the adult's hip are located near the center of the carrier 10. Each leg hole 20 has a diameter of about three inches (3″), and is separated laterally from the other by about three inches (3″), forming a seat crotch 44. Fabric edging placed around the circumference of each leg hole 20 forms a leg hole cuff 46 which reinforces the fabric of the crotch 44 and provides a finished edge for each leg hole 20.

A significant and novel feature of the present invention is represented by detachable leg warmers 48, which provide an effective means for protecting the baby's legs from cold or inclement weather. Each leg warmer 48 comprises a cylindrical fabric element having an interior diameter matching the exterior diameter of the leg hole cuffs 46, and a length sufficient to accommodate the gangly legs of a two- or three-year old child. As presently preferred, the interior diameter of the leg warmers 48 is about three and three-quarters inches ($3\frac{3}{4}''$), and the length of the leg warmers is about fifteen inches (15"). A leg warmer cuff 50 is formed around each end of each leg warmer 48 by adding edging to the circumferential edge of the leg warmer. A lower end of each leg warmer 48 can be left open, or it can be closed to more effectively protect the baby's legs. Four conventional heavy duty snap halves 52 spaced evenly around the interior circumferential surface of an upper leg warmer cuff 50 of each leg warmer 48, and four complementary heavy duty snap halves 54 spaced evenly around the exterior circumference of each leg hole cuff 46 of the carrier 10 allow the leg warmer to be quickly and easily attached to and detached from the leg holes 20 of the carrier. It is understood that other detachable fastening devices, including sliding toothed fasteners (or "zippers") and hook-and-pile closures (such as Velcro or its equivalent) could be used in place of conventional snaps.

Each leg warmer 48 includes three grow tucks 56 to allow the leg warmer to be extended in length as the child's legs grow. Each grow tuck 56 consists of a circumferentially oriented, Z-shaped double fold one half inch (½") wide in the fabric of the leg warmer, forming a triple-layered band of fabric extending circumferentially around the leg warmer. The three grow tucks 56 allow each leg warmer 48 to be extended a total of about three inches (3") in length. A growth display 58 can be inserted into the grow tucks 56 such that as a grow tuck is released in order to extend the length of the leg warmer, an additional element of the growth display is revealed. For example, the growth display 58 might comprise a colorful representation of a railroad train, wherein an additional railroad car of said train is revealed as each grow tuck 56 is released.

Figure 3:
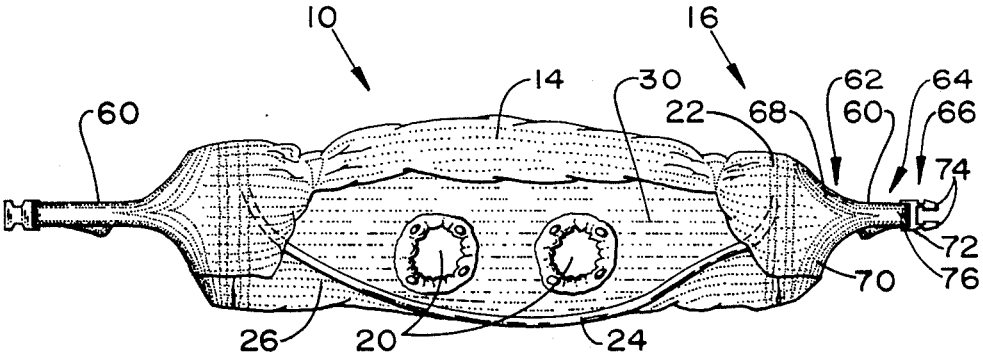
FIG. 3 is a plan view of the carrier of FIG. 1 in an open position, showing the leg holes in the seat bottom, and the back in a raised position with the back edge firmly anchored by the back support points at the seat ends.

FIG. 3 shows the carrier 10 in an open position which is used to conveniently load a baby into the carrier. In the open position the front seat edge 22 of the seat 12 is pulled downward to open the trough shaped seat 12 and expose the leg holes 20 for the baby's legs, and the back 14 is pulled into a raised position.

The strap assembly 16, which allows the carrier 10 to be formed into a circular sling and looped over the adult's shoulder, is made from the same soft quilting used in the seat 12 and carrier back 14, to cushion the load on the shoulder, to give the carrier 10 a coordinated appearance, and to lower manufacturing costs. In the presently preferred embodiment of the carrier 10 of this invention, the strap assembly 16 comprises two straps 60, each fixedly attached along an attached strap end 62 to one of the seat ends 22 and extending outward from said attached strap end to an opposite buckled strap end 64, and a buckle 66 attached to each such buckled end. The width of the strap 60 is relatively narrow at the buckled strap end 64 and for most of the length of the strap, while at the attached strap end 62 the strap is substantially wider, being equal to the width of the seat end 22. A flare 68 provides a smooth transition between the narrow width of the strap 60 at the buckled strap end 64 and the greater strap width at the attached strap end 62. The load distribution and stress reduction provided by the design of the flare 68 is enhanced by the addition of flare reinforcing stitching 70 in a pattern of three nested chevrons oriented with their apices toward the buckled strap end 64. Each side of each chevron begins at one side edge of the flare 68 at a point relatively near to the attached strap end 62, and curves from there substantially parallel to said edge of the flare 68 for a predetermined distance, and then runs straight from said side edge toward the center of the strap 60.

The buckle 66 allows the buckled strap ends 64 to be detachably connected to each other, forming the carrier 10 into a circular sling. The buckle 66 comprises two buckle halves 72, each attached to the buckled strap end 64 of one of the straps 60. A child safe buckle 66 employing a connection mechanism which can only be released by the simultaneous application of significant force to two opposing buckle release latches 74 located on opposite side surfaces of the buckle is strongly preferred in order to prevent the child from disconnecting the buckle and precipitating a sudden and painful descent. In the preferred child safe buckle, the buckle release latches 74 are spaced two inches (2") apart, a distance greater than the span of the child's hand, and a force which exceeds the gripping strength of the child is required to operate said latches. It is of course feasible to use other child safe strap release mechanisms, whether incorporated into the buckle 66 or otherwise mounted on the strap assembly 16.

Figure 4:
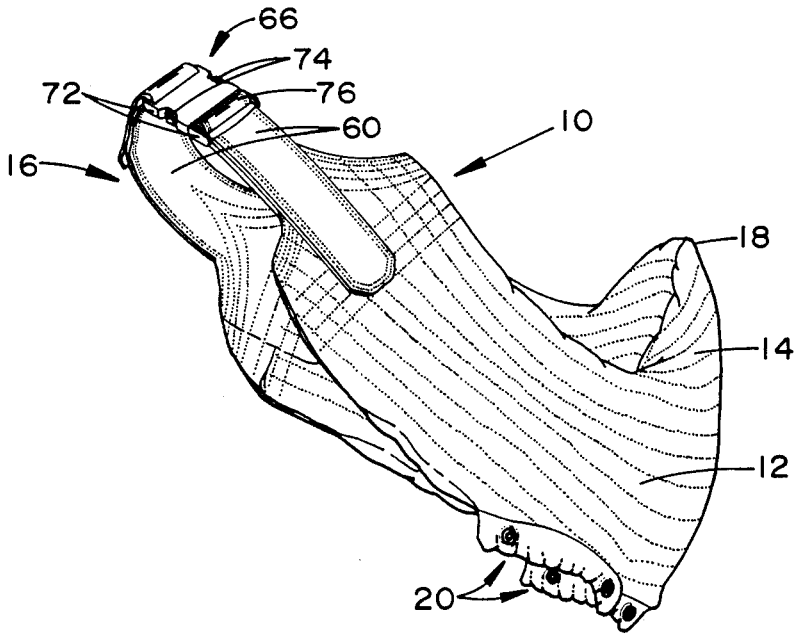
FIG. 4 is a perspective view of the carrier of FIG. 1 with the straps connected to each other and the back in the raised position with the back edge tensioned downward by the back support points.
Figure 5:
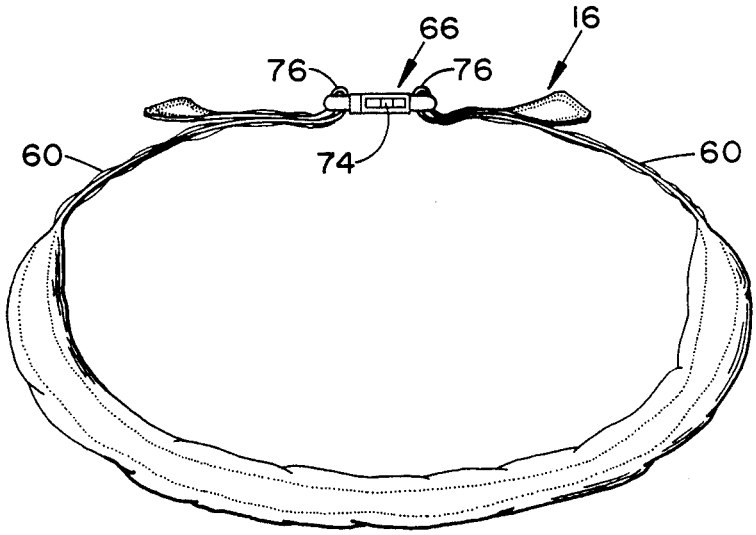
FIG. 5 is a view from above the carrier of FIG. 4, showing particularly the buckle for detachably connecting the straps.

As best seen in FIG. 4 and 5, each buckle half 72 includes a conventional strap length adjustment 76 for adjusting the length of the strap 60 to which it is attached. The provision of a strap length adjustment 76 on each buckle half allows the position of the buckle 66 to be varied to prevent the buckle from painfully engaging the user's collarbone or shoulder blade while maintaining the desired length of the strap 60. It is however understood that the buckle 66 could include only a single strap length adjustment 76.

Although the two strap, doubly adjustable strap assembly described above has been found to best combine comfort with simplicity of design and manufacturing, there are several alternative designs which could also provide a functional strap assembly 16. One such alternative strap assembly incorporates a single strap arranged at a first seat end and extending through a strap fastening device arranged at the opposite second seat end. Another alternative might include a similar single strap arranged at the first seat end and looped through a ring-like or bar-like connector attached to the opposite second seat end, and thence doubled back toward the first seat end, with a fastening device arranged at the free distal end of the strap allowing said free end to be fixed in place relative to the first seat end, thus allowing adjustment of the length of the strap assembly.

Figure 6:
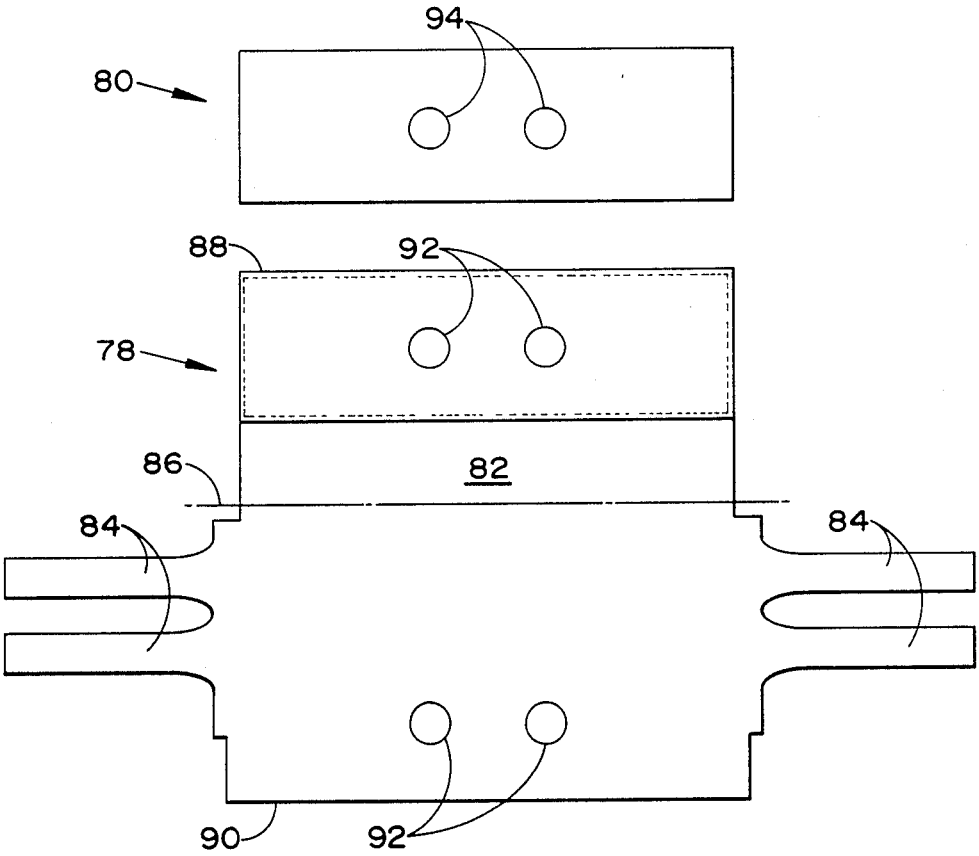
FIG. 6 is a plan view of the patterns used to cut, mark and sew the carrier of FIG. 1.

The method by which the presently preferred embodiment of the carrier 10 is constructed is described with reference to FIG. 6, showing a carrier pattern 78 and a liner pattern 80, each of which comprises a single piece of flat material, usually paper or fabric, used as a template for cutting, marking and sewing. Because the carrier is constructed from a double layer of quilting throughout, the carrier pattern 78 necessarily doubles every element of the carrier. The seat liner, being a single thickness of material, matches the liner pattern 80 exactly. In the description which follows, terms which refer to elements of the carrier or the seat liner refer equally to the corresponding elements of the carrier pattern 78 and liner pattern 80, respectively, from which they are formed.

The carrier pattern 78 comprises a rectangular pattern body 82 measuring thirty six inches (36") by thirty seven inches (37"), from which the seat 12 and carrier back 14 are formed, and four strap halves 84 measuring sixteen inches (16") in length and three inches (3") in width. A pattern centerline 86 extending between opposing side edges of the body exactly midway between a upper pattern edge 88 and an opposite lower pattern edge 90. Parallel pairs of strap halves 84 located between the pattern centerline 86 and the lower pattern edge 90 extend laterally outward from the opposing side edges of the pattern body 82. A centermost strap half 84 of each pair is spaced outwardly from the pattern centerline 86 toward the lower pattern edge 90, with an upper side edge of said strap half separated from the pattern centerline by one inch (1"). The outermost of each pair of strap halves 84 is separated from the adjacent innermost strap half by a gap of two inches (2"). Each strap half 84 is widened near the pattern body 82 to form the flare 70. The carrier pattern 78 includes four pattern body holes 92 which form the two leg holes 20 of the seat 12. Each pair of four inch (4") pattern body holes 92 is separated laterally by the four inch (4") crotch 44. One such pair is located near the upper pattern edge 88, with the center of each pattern body hole 92 of said pair spaced six inches (6") inward from the upper pattern edge. The other pair of pattenn body holes 92 is centered six inches (6") inwardly from the lower pattern edge 80. The liner pattern 80 similarly includes two four inch (4") diameter liner holes 94 centered on the longitudinal axis of the rectangular liner pattern 80, and separated laterally from each other by the crotch 44.

To cut out the quilted fabric of the carrier 10, the liner pattern 80 is placed on a piece of double-face reverse-patterned quilting and the fabric is cut following the perimeter of the carrier pattern. The pattern body holes 92 are then cut into the interior of the pattern body 82. Similarly, the seat liner 34 is cut out using the liner pattern 80, and the liner holes 94 are cut. Next, the rectangular seat liner 34 is pinned and then stiched to the upper portion of the pattern body 82, with one longer edge of the seat liner 34 flush with the upper pattern edge 88, superimposing the liner pattern body holes 94 over the upper pair of pattern body holes 92. The upper half of the pattern body 82, together with the seat liner 34, is then folded down along the pattern centerline 86 until the upper pattern edge 88 meets the lower pattern edge 90 to form the front seat edge 24 of the seat 12, and the two pairs of pattern body holes 92 together with the one pair of liner holes 94 meet to form the two leg holes 20 of the seat 12. The resulting fold line along the pattern centerline 86 defines the back edge 18 of the carrier back 14. Edging is pinned and sewn to the circumferential edges of the leg holes 20, forming the leg hole cuffs 46, and to the front seat edge 24, and the leg hole snaps 54 are attached to the leg hole cuffs. The seat 12 is formed by folding the front seat edge 24 upwardly toward the pattern centerline 86 along a line paralleling the front seat edge and spaced inwardly therefrom by five and one-half inches (5½"), and temporarily pinning each end of the front seat edge 24 to one of the seat ends 22. Next, the gathers 38 which reinforce and tighten the back edge 18 are formed in the carrier back 14 and stiched with the tripled gather stitching 40. The carrier back 14 is then placed into its closed position, as shown in FIG. 2, and the two strap halves 84 of each pair of strap halves arc superimposed to form a single strap 60, by folding the carrier back 14 downwardly along a line parallel to the back edge 18 and running between the centers of the gaps between the opposing pairs of strap halves. Each pair of superimposed strap halves 84 is then pinned, stitched and topstitched to yield a two inch (2") wide strap 48. Four straight, parallel rows of seat end reinforcing stitching 42 spaced three-quarters of an inch (¾") apart are added to the seat end 22, firmly attaching the temporarily pinned ends of the front seat edge 24 and the back edge 18 to the back support points 36 in the seat end. Three substantially parallel rows of flare reinforcing stitching 70 spaced three quarters of an inch (¾") apart are added in the pattern of nested, flared chevrons described above. Finally, the two buckle halves 76 are added to the buckled strap ends 64 of the straps 60, and a conventional laundry tag containing washing and care instructions is sewn in.

The leg warmers 48 are manufactured from left-over quilting located in the corners defined by the side edges of the pattern body 82 and the inner edge of the inner strap halves 84 described above. If the leg warmers 48 are constructed from a single thickness of quilting, two such leg warmers can be made from the left-over fabric from a single carrier 10. If the leg warmers 48 are double layered, however, a single carrier 10 produces only enough left-over fabric for one leg warmer. The first step in making a leg warmer is to trim the left-over fabric to form a rectangle. If a double-layered leg warmer is being made, two such rectangles are combined to form a single rectangle. The rectangle is then folded longitudinally to superimpose two side edges which are then sewn together, forming the cylindrical leg warmer. The grow tucks 56 are formed into and stitched around the circumferential surface of the leg warmer, with the growth display 58 inserted into the grow tucks as desired. Edging is pinned and sewn along the two opposing circumferential end edges of the leg warmer to form the leg warmer cuffs 50. Finally, the four leg warmer snaps 52 are attached to an upper leg warmer cuff 50 of each leg warmer to allow the leg warmer to be attached to a leg hole cuff 46 of the carrier 10.

The carrier 10 is preferably constructed from a double-face reverse-patterned quilting, allowing otherwise scrap fabric to be reversed and used as decorative, contrasting edging along the front seat edge 24 and in the leg hole cuffs 46 and leg warmer cuffs 50. The use of such quilting also allows the leg warmers 48 to be made from the same fabric as the carrier 10, with either the same side of the fabric facing outward to give the carrier 10 and leg warmers 48 a coordinated appearance, or with the reverse side facing outward to provide a decorative contrast. A piece of double-face reverse-patterned quilting measuring thirty six inches (36") by seventy two inches (72") is sufficiently large to yield all of the elements of the carrier including the leg warmers and edging, but excluding the seat liner 34 which is constructed from a different, stronger material. The use of quilting having a facing material consisting of 30% to 100% cotton, and up to 70% polyester, with a layer of 100% polyester sandwiched between the facing, has been found to effectively control shrinkage during washing, although it is understood that different proportions of staple textiles can be used, depending on the particular wear and washing characteristics desired. The seat liner 34 is a washable, heavy-weight yet pliable material such as bull denim, in a blend of 50% cotton and 50% polyester to control shrinkage. A piece of such material measuring thirty seven inches (37") by fifteen inches (15") is sufficient to yield one seat liner.

The presently preferred embodiment of the hip sling baby carrier 10, having a single, child-safe strap assembly 16 instead of a complicated array of hardware and straps, having detachable leg warmers 48 with grow tucks 56 to accommodate the baby's growth, and constructed from a single piece of durable double-face reverse-patterned quilting, can be profitably manufactured and sold for less than the cost of conventional front-type baby carriers, and for less than the cost of conventional back-type carriers, thus providing lower income families and especially single-parent families with a comfortable and affordable means for transporting small children. The same features described above for a full-sized hip sling baby carrier can be incorporated into a reduced-size doll carrier 10 for carrying a doll on the hip of a child in the same manner in which a baby is carried on the hip of an adult using the full-size carrier. Such a doll carrier is expected to be a realistic, enjoyable and durable doll accessory, having particular appeal to children whose parents own and use a full-size baby carriers.

It will be appreciated that, although specific embodiments of the baby or doll carrier have been described herein for purposes of illustration, various modifications may be made without departing from the spirit and scope of the invention. Accordingly, the scope of the present invention is set forth in the following claims, rather than being limited to the forgoing embodiments.

What is claimed is:

1. An improved hip sling baby or doll carrier comprising:

(a) a trough-shaped seat fabricated of one piece of quilting material comprising a substantially rectangular longitudinal extending seat bottom portion with leg holes, a substantially rectangular longitudinally extending seat front portion, and a substantially rectangular longitudinally extending seat back portion, all of said seat portions being stitched together in overlapping fashion at the ends thereof with the back and front end portion overlapping the ends of the seat bottom portion and overlapping each other and being stitched together for at least most of the lateral dimension thereof, the overlapping and stitching arrangement being such that when the carrier is not in use the seat folds flat with a free edge of the front seat portion lying adjacent a free edge of the rear seat portion and such that when the carrier is in use the free edges of the front and rear seat intermediate the ends thereof portions are separated from each other and such intermediate front and rear portions serve as the front and rear parts of the seat with such rear part upwardly extending from the bottom seat portion to engage and firmly support the baby's or doll's back; and (b) strap means integrally formed with and extending longitudinally of the overlapped seat end portions and including strap connection means for connecting opposite free ends of the strap means to each other.

2. A baby or doll carrier according to claim 1, wherein the seat back portion includes one or more gathers and gather stitching augmenting the support of the baby's or doll's back when the carrier is in use.

3. The carrier of claim 2, further including multiple parallel rows of seat reinforcing stitching extending transversely between opposed side edges of the seat ends with the seat ends and strap means further including flare reinforcing stitching in nested chevron pattern.

4. The carrier of claim 1, further including leg warmers each comprising a substantially cylindrical fabric element having connecting means disposed near one end opening for detachably connecting the leg warmers to the carrier adjacent a leg hole of the carrier.

5. A leg warmer for use with a baby carrier of the hip-sling type having two leg holes centered near a bottom fold of a seat of said carrier, said leg warmer comprising a substantially cylindrical fabric element having connecting means disposed near one end opening for detachably connecting said leg warmer to a leg hole cuff surrounding one of the leg holes of the baby carrier using conventional snaps disposed around a leg warmer cuff of the leg warmer.

6. The leg warmer of claim 5, further including length extension means for extending the length of the leg warmer in order to accommodate growth of the child's legs, said length extension means comprising a grow tuck encircling the leg warmer, wherein the release of said grow tuck causes the length of the leg warmer to be increased by a predetermined distance.

7. The leg warmer of claim 6, further including a multi-element growth display, wherein an additional element of said growth display is revealed when the grow tuck is released.

* * * * *